United States Patent [19]

Box

[11] Patent Number: 4,635,510

[45] Date of Patent: Jan. 13, 1987

[54] PLIERS

[75] Inventor: Joe G. Box, Macedonia, Ohio

[73] Assignee: Milbar Corporation, Chagrin Falls, Ohio

[21] Appl. No.: 791,428

[22] Filed: Oct. 25, 1985

[51] Int. Cl.[4] ..... B25B 7/14

[52] U.S. Cl. ..... 81/319; 81/417

[58] Field of Search ..... 81/415, 416, 417, 427, 81/427.5, 318, 319, 320, 321, 322, 323, 324, 325, 326, 327; 267/155, 58

[56] References Cited

U.S. PATENT DOCUMENTS

| | | | |
|---|---|---|---|
| 523,136 | 7/1894 | Trakofler | 81/325 |
| 924,357 | 6/1909 | Irwin | 30/90.6 |
| 1,222,513 | 4/1917 | Aaron | 81/9.44 |
| 1,578,438 | 3/1926 | Hintz | 30/186 |
| 2,375,512 | 5/1945 | Baade | 81/419 |
| 3,130,616 | 4/1964 | Miller | 30/91.2 |
| 3,176,551 | 6/1965 | Hansen | 81/423 |
| 3,241,814 | 3/1966 | Forte | 81/417 |
| 3,271,847 | 9/1966 | Millheiser | 29/229 |
| 3,733,626 | 5/1973 | Allen | 7/5.3 |
| 3,733,627 | 5/1973 | Epstein | 7/5.4 |
| 3,890,858 | 6/1975 | Lawson | 81/9.5 R |

*Primary Examiner*—Frederick R. Schmidt
*Assistant Examiner*—Maurina Rachuba
*Attorney, Agent, or Firm*—Watts, Hoffmann, Fisher & Heinke Co.

[57] ABSTRACT

In a hand tool, a pair of elongated tool arms interconnected by a pivot, a torsion spring having legs which are connected respectively to the tool arms to bias the arms to an open position, and a plier lock element member having a spaced pair of eyes and a connecting bridge, with the plier element being slidably connected to the torsion spring legs such that the element is movable between locking and release positions. When in the lock position, the element is near the spring interconnection and acts to restrain the spring from biasing, and to inhibit relative work movement of the tool arms. When in the release position, the element selectively permits work performing movement of the arms about the pivot. One of the spring legs includes a working offset portion, and each of the spring legs includes a locking offset portion located near its connection with the associated one of the tool arms.

11 Claims, 5 Drawing Figures

PLIERS

DESCRIPTION

1. Technical Field

The present invention relates generally to plier type hand tools and in particular to an apparatus for selectively permitting and inhibiting relative hand tool movement.

2. Background Art

Plier-type tools having a spring for the separation of the tool handles and jaws have been well known for many years. A variety of methods have also been known for controlling the relative separation of the jaw and handles to provide degrees of open and closed positions. Employing such devices enables convenient storage and enhances tool usage through added control of handle and jaw separation.

Typically plier movement limiting devices inhibit jaw separation by application of devices associated with the tool handles. These have been proposals for devices of a type incorporated into existing parts of the pliers and of a type requiring additional retaining piece associated with the plier handles.

Prior proposals for locking devices have several disadvantages, one of which is that they often interfere with operation of the tool jaws by accidental movement into the closed position. Some proposed locking devices have protrusions from the surface of the tool which are easily disturbed during operation and storage. Such interference may cause the tool function to be impaired or a tool to be disengaged from its locked position.

In one device, the inhibiting means includes a bar member coupled to a pair of lever handles and slidably engaged along the handles into the locked position. The disadvantage of this arrangement is that during operation of the tool, the bar member may fall into the locked position, requiring manual disengagement before use of the tool may continue. Another disadvantage is that because the bar member operates on the lever handles, other devices mounted on the handles will be difficult to operate and may interfere with operation of the locking bar.

In another construction, a lever is pivotally mounted on one handle for engagement with the jaw portion when in the locked position. It is believed that this construction is expensive to manufacture, since it requires additional pieces to be mounted on the handle.

Another type of device provides a set screw-slide nut combination located near the pivot of the tool. To engage the device, the set screw is loosened and the combination moved to the desired position along a slot formed in the tool handle. The slot is positioned such that the combination may be moved to obtain numerous degrees of handle separation. Tightening of the set screw inhibits separation of the handles beyond the engagement point with the screw-slide combination. While such a combination does provide an acceptable stop means, the device suggested requires additional parts and further adaptation of the handle portions.

DISCLOSURE OF INVENTION

The present invention provides a new and improved plier type hand tool that includes a device for retaining tool handles and jaws in open and closed positions. The device uses the spring which biases the tool handles to obtain a variety of tool positions without inhibiting use of the tool.

In the illustrated embodiment the hand tool comprises a pair of interconnected lever arms. Each arm includes a handle, jaw and web portion. A torsion spring having a pair of legs interconnected by a spring loop as also disclosed. The spring loop is generally aligned with the pivotal interconnection of the arms. The spring legs are preferably connected to respective lever arms, and act to bias the tool arms toward the open position.

In the preferred embodiment a plier control element or loop member is provided which slidably connects to the spring legs and is movable between plier lock and release positions. As illustrated, the element includes a spaced pair of eyes and a connecting bridge. When in the lock position the element is located near the operative interconnection of the spring legs and tool arms, and acts to restrain the spring from biasing the tool arms. In the lock position, the element also retains the jaws in a substantially closed position.

According to the release position feature of the preferred embodiment, the plier element is located near the spring loop to permit relative working movement of the arms about the pivot.

According to a feature of the invention, one of the spring legs includes a working offset. The working offset functions to inhibit unintended movement of the plier element from the release position to the lock position. In the illustrated embodiment the offset is generally V-shaped.

In one disclosed embodiment, at least one of the spring legs includes a locking offset which is located near its operative connection with the lever arm, and is positioned for restraining the element from unintended movement out of the lock position. In the illustrated embodiment each of the spring legs includes a locking offset which is located near the operative connection.

The present invention provides a plier control device which efficiently restrains a plier tool from performing relative work movement. The construction of the disclosed device is readily manufacturable and inexpensive since, unlike prior devices, the plier element is configured to operate along the legs of the existing torsion spring. The plier lock element is further adapted to minimize accidental locking interference during operation of the tool, and to avoid accidental disengagement of the element from the tool lock position.

Additional features and adaptations of the invention will be readily apparent from the following detailed description of an embodiment illustrated in the accompanying drawings.

BEST MODE FOR CARRYING OUT THE INVENTION

Figure 1:
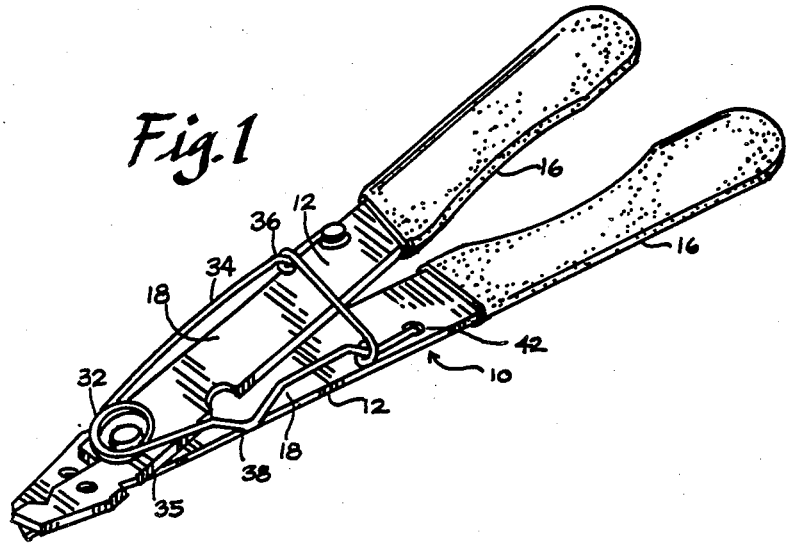
FIG. 1 is a perspective view of the hand tool and plier control device embodying this invention.

The overall structure of a hand tool and plier control device embodying this invention is best seen in FIG. 1. The invention comprises a plier type hand tool, generally referenced by numeral 10, having a pair of elongated arms 12. In the illustrated embodiment each arm includes a jaw portion 14, a handle portion 16 and a web portion interconnecting the two portions 14, 16. The tool arms 12 are interconnected along the web portions 18 at a pivot 35 spaced from ends of the tool arms.

The tool preferably includes a torsion spring located in a plane substantially parallel and spaced from the arms 12. The spring 30 includes a pair of legs 34 spaced from one another and interconnected by a spring loop 32. The spring loop 32 is generally aligned axially with the pivot 35 connecting the arms 12.

Figure 2:
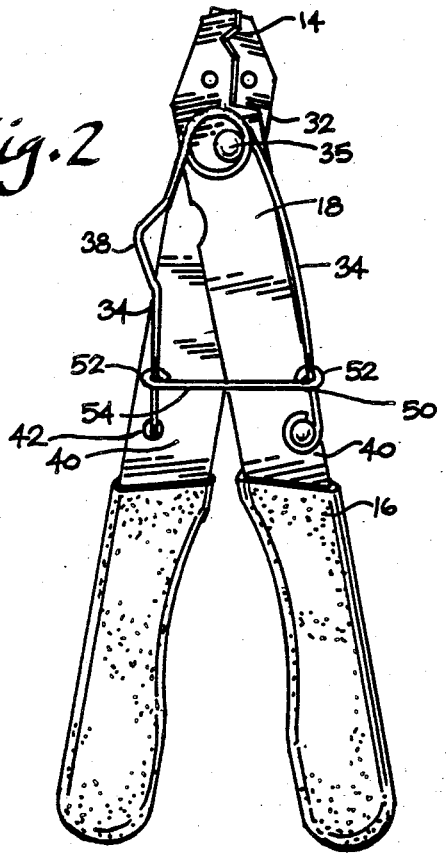
FIG. 2 is a plan view of a side of the hand tool showing the biasing spring and plier element in the locked position.
Figure 3:
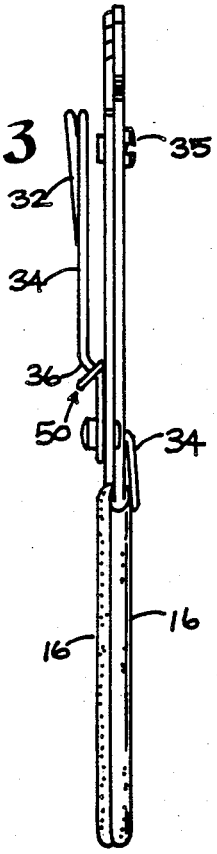
FIG. 3 is a side view of the hand tool also in the locked position.
Figure 4:
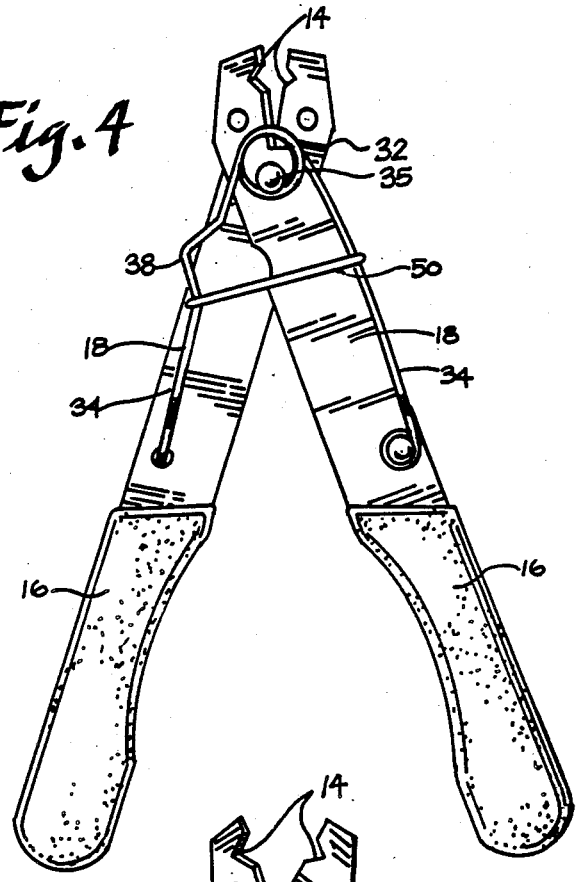
FIG. 4 is a plan view of the hand tool in release position.
Figure 5:
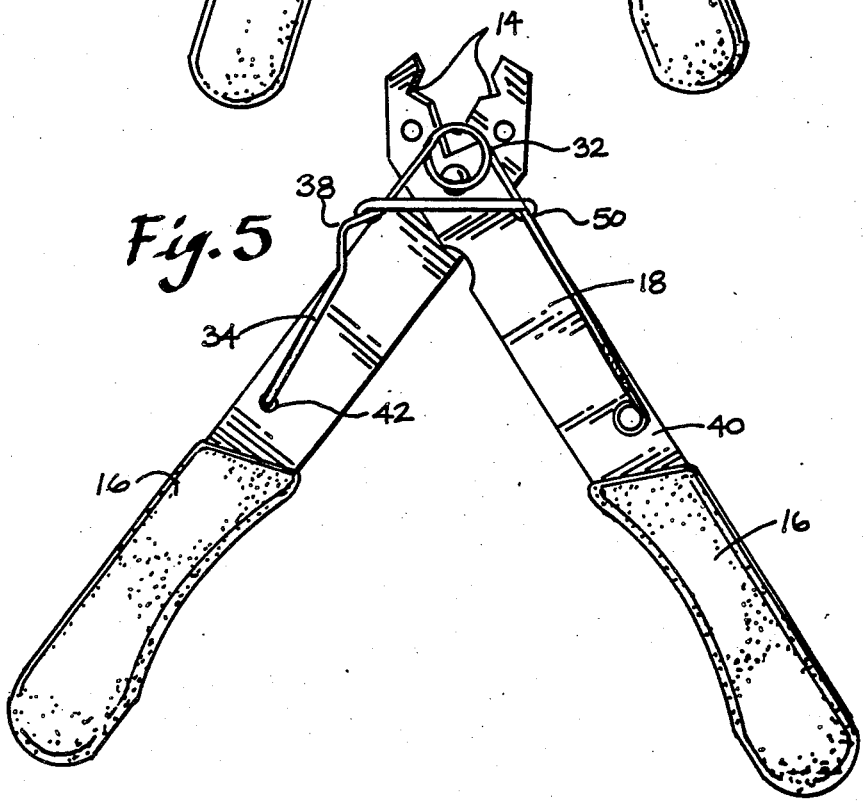
FIG. 5 is a plan view of the hand tool similar to FIG. 4, but showing the tool in an alternate release position for working movement.

In the preferred embodiment, the spring legs 34 are connected to respective tool arms 12, and operate to bias the arms toward an open position as shown in FIGS. 4 and 5. Referring to FIGS. 2 and 3, one spring leg 34 is securely mounted on a surface 40 of the tool handle portion 16 of an arm 12. Another spring leg 34 preferably projects through an aperture 42 in the surface 40 of the tool handle 16.

In the preferred embodiment, a loop member or plier control element 50 is provided. The element comprises a pair of spaced eyes 52 which are around the spring legs 34 and a bridge 54 connecting the eyes 34. The element 50 is slidably connected to the spring 30 and is movable between plier lock and release positions, which selectively permit and inhibit pivotal movement of the arms 12.

In order to prevent or permit movement of the tool arms 12, offsets are provided on the spring legs 34 for operatively engaging the eyes 42 of the plier element 50. In the illustrated embodiment, one spring leg includes a generally V-shaped working offset 38 which operates to inhibit interfering movement of the plier element 50 in the release position while the tool 10 is in use. When in the release position, the plier element is located near the spring loop 50 and able to perform pivotal working movement.

Each spring leg preferably includes a locking offset 36 located near the interconnection with the tool arm 12 for engaging the loop eyes 52. The locking offsets 36 operate to restrain the plier element 54 in the lock position as shown in FIGS. 1–3, and to restrain the spring 30 against its biasing action.

In accordance with the invention, the plier element 50 is capable of slidable movement along the spring legs 34 between locking and release positions. In order to move the tool from the release position to the lock position, the handles 16 are compressed against the spring 30, and the eyes 52 of the plier element 50 slidably engaged with the locking offset portions 36. Once in the locked position, the plier element 50 is prevented from disengagement due to the biasing action of the spring legs 34 against the plier element eyes 52.

In the illustrated embodiment, the plier element 50 and locking offset portions 36 are configured to minimize accidental locking of the tool during operation. The tool structure is also configured to avoid interference with other tool accessories which may be positioned on a surface of the tool handles 16.

With the illustrated embodiment, the plier control element 50 operates on a modified existing torsion spring 30 to reduce the expense of manufacturing the plier control device of the present invention. It should also be understood that the working offset portion 36 of the spring leg 34 could be further modified to provide several release positions by including additional offsets.

Although the invention has been described with a certain degree of particularity, it should be apparent that numerous changes can be made to it by those skilled in the art without changing the spirit or scope of the invention as hereinafter claimed.

I claim:

1. A plier type hand tool comprising:

(a) a pair of pivotally interconnected lever arms each including handle, jaw and web portions;

(b) a torsion spring including a pair of legs interconnected by a spring loop generally aligned axially with the arm pivot;

(c) the spring legs being respectively operatively connected to the lever arms to bias the arms toward an open position;

(d) a plier control element slidably carried by the spring and movable between plier lock and release positions, the element when in the lock position being near the operative interconnections of the spring legs and lever arms, and restraining the spring against its biasing action whereby to retain the jaws substantially in a closed position; and (e) the element when in the release position being near the loop whereby to permit work performing relative movement of the arms about the pivot.

2. The plier tool of claim 1 wherein one of the legs includes a working offset for inhibiting unintended movement of the element from the release position.

3. The plier tool of claim 2 wherein the offset is generally V-shaped.

4. The plier tool of claim 2 wherein at least one of the legs includes a locking offset near its operative connection for restraining the element from unintended movement from the lock position.

5. The plier tool of claim 4 wherein each of the legs includes a locking offset near the operative connection.

6. The plier tool of claim 1 wherein at least one of the legs includes a locking offset near its operative connection for restraining the element from unintended movement from the lock position.

7. The plier tool of claim 6 wherein each of the legs includes a locking offset near the operative connection.

8. A hand tool comprising:

(a) a pair of elongated tool arms;

(b) the tool arms each having a jaw portion and a handle portion;

(c) a pivot interconnecting said tool arms and spaced from ends of the tool arms;

(d) a torsion spring;

(e) the torsion spring having spaced legs and an interconnection connecting the legs together, the legs being connected respectively to the arms to bias the arms toward an open position;

(f) a loop member;

(g) said loop member having a spaced pair of eyes and a connecting bridge; and (h) said loop member eyes being disposed respectively around said torsion spring legs, the loop member being slidably carried by the spring between locking and release positions for selectively permitting and inhibiting pivoted relative movement of said tool arms.

9. The hand tool of claim 1 wherein one spring leg has a working offset portion for limiting unintended movement in the release position.

10. The hand tool of claim 8 wherein each of said spring legs includes a locking offset portion for selectively engaging said loop member eyes.

11. A plier type tool comprising:

(a) first and second lever-shaped elongated arms;

(b) said elongated arms each having a jaw portion and a handle portion interconnected by a web portion;

(c) a pivot connecting the web portions at a location spaced from arm ends for movement of the arms between open and closed positions;

(d) a torsion spring for biasing the tool jaw and handle portions toward the open position;

(e) the spring being located in a plane substantially parallel to and spaced from the elongated arms;

(f) the spring having first and second legs spaced from one another and an interconnection connecting the legs together;

(g) said first spring leg being securely mounted on a surface of the tool handle portion of the first arm, said second spring leg projecting through an aperture in a surface of the tool handle portion of the second arm;

(h) a loop member having a pair of spaced eyes and a connecting bridge;

(i) the spring legs having locking offset portions for selectively engaging said loop member eyes;

(j) one spring leg having a working offset portion positioned for limiting unintended movement from the release position to the locking position;

(k) said loop member eyes being respectively around said torsion spring legs, the loop member being slidable along the spring between locking and release positions for selectively permitting and inhibiting pivoted relative movement of said tool arms;

(l) the tool being movable from the release position to the locking position upon compression of the handle portions against the torsion spring and slidably engaging the loop member eyes with the locking offset portions, the loop member being interposed between the locking offset portions of the spring legs;

(m) said spring legs being adaptably mounted for biasing the locking offset portions against the loop member eyes when the tool is in the locking position;

(n) said loop member and locking offset portions being configured to minimize accidental locking interference during operation of the tool and to avoid disengagement from the tool locking position upon movement or accidental contact with other items during storage of the tool; and (o) the torsion spring and loop member being positioned for operative engagement in a plane spaced from and parallel to said elongated arms and adapted to avoid interference with additional tool accessories positioned on the tool handle portions.

* * * * *